United States Patent [19]

Karpisek

[11] 4,309,861

[45] Jan. 12, 1982

[54] METHOD AND APPARATUS TO STRETCH WRAP AN OBJECT IN PLASTIC FILM

[76] Inventor: Ladislav S. Karpisek, 86 Woodfield Blvd, N.S.W. 2229, Caringbah, Australia

[21] Appl. No.: 114,397

[22] Filed: Jan. 23, 1980

[30] Foreign Application Priority Data

Aug. 18, 1978 [AU] Australia ..... PD5555

[51] Int. Cl.[3] ..... B65B 43/34

[52] U.S. Cl. ..... 53/556; 53/567; 53/570; 53/390

[58] Field of Search ..... 53/441, 459, 556, 567, 53/570, 585, 384, 390; 269/116, 124, 48.1

[56] References Cited

U.S. PATENT DOCUMENTS

| | | | |
|---|---|---|---|
| 1,159,279 | 11/1915 | Schaefer | 269/116 |
| 1,537,889 | 5/1925 | Seckinger | 269/124 |
| 2,823,503 | 2/1958 | Worf | 53/570 |
| 3,675,388 | 7/1972 | Lems | 53/570 |
| 3,879,918 | 4/1975 | Lerner | 53/441 |
| 3,880,415 | 4/1975 | Fujioka | 269/48.1 |
| 3,902,303 | 9/1975 | King | 53/556 |
| 3,961,459 | 6/1976 | Workse | 53/556 X |
| 4,050,219 | 9/1977 | Higgins | 53/567 |
| 4,063,401 | 12/1977 | Higgins | 53/567 |
| 4,117,879 | 10/1978 | Rutherford | 269/48.1 |

*Primary Examiner*—John Sipos

*Attorney, Agent, or Firm*—Emory L. Groff, Jr.

[57] ABSTRACT

Method and apparatus to stretch wrap an object in plastic film, the method comprising the steps of locating a length of elastically stretchable plastic film tube on a holder and expanding the holder to stretch the tube to a size enabling the tube and the holder to be passed over the object to be wrapped and at the same time stripping the tube off the holder so the tube can contract and elastically embrace the object.

3 Claims, 13 Drawing Figures

METHOD AND APPARATUS TO STRETCH WRAP AN OBJECT IN PLASTIC FILM

This invention relates to a method of and apparatus for stretch wrapping.

Stretch wrapping is conventionally a form of packaging in which a band of stretchable plastic film is wrapped under tension about an article, a group of articles, or a pallet with an article or articles stacked thereon, to make a united load. In the past this has been done by either moving a holder of stretch wrap film around the object(s) to be wrapped, at the same time dispensing film under tension from the holder, or by rotating the object(s) before a holder from which stretch film is dispensed under tension.

Both of the foregoing methods have drawbacks such as high capital. Cost of equipment, difficulty with end fastening of the film band, and end covering of the object(s) wrapped is difficult. There are also dangers associated with mechanical equipment which rotates. Until now no better methods have been available.

The method of the invention does not require sophisticated or expensive equipment, it is easy and safe to operate, provides immediate facility for end sealing the wrapped object(s). The apparatus of the invention is versatile in that wrapping can be carried out at any location without the need for electrical power which is necessary with presently known powered equipment.

Accordingly the method of the present invention comprises the step of providing a length of flexible elastically stretchable plastic film tube having a basic unstretched internal cross-sectional dimension which is smaller than the external cross-sectional dimension of the object(s) to be wrapped and a stretch capability enabling it to be expanded to an operative internal cross-sectional dimension greater than the external cross-sectional dimension of the object(s) to be wrapped; storing at least the major part of the length of the tube as a concertina folded band around an expandable holder; expanding the holder to enlarge the cross-sectional dimension of the tube thereon to the operative internal dimension; passing the object(s) through the holder and the expanded tube thereon and at the same time progressively stripping the tube from the holder so it will contract and elastically embrace the object(s).

Several embodiments of the invention will now be described with reference to the accompanying drawings in which:

FIG. 1 schematically illustrates a plastic bag and a holder therefor.

FIG. 2 schematically illustrates the plastic bag of FIG. 1 being mounted as a concertina folded band on the holder.

FIG. 3 schematically illustrates the bag fully mounted on the holder.

FIG. 4 schematically illustrates the expansion of the holder to enlarge the internal cross-section of the bag.

FIG. 5 schematically illustrates an expanded bag about to be passed over a loaded pallet on a stand.

FIG. 6 schematically illustrates the expanded bag passing over the loaded pallet.

FIG. 7 schematically illustrates the bag partly stripped from the holder and contracted onto part of the pallet load.

FIG. 8 schematically illustrates the load pallet encased in the contracted bag.

Figure 11:
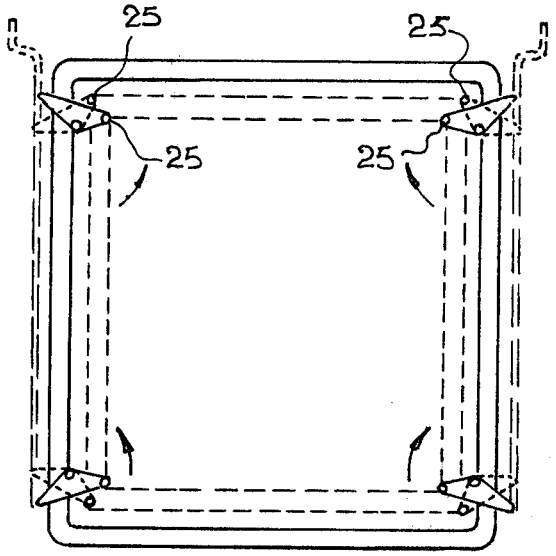

FIG. 11 schematically illustrates another form of holder.

Figure 12:
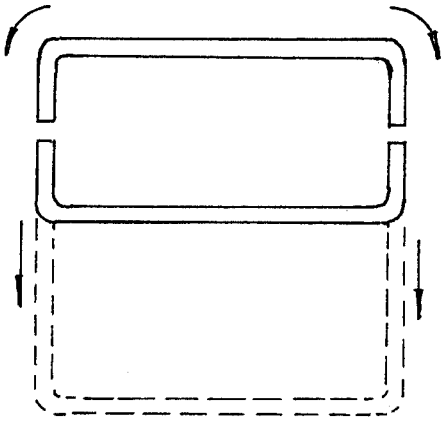

FIG. 12 schematically illustrates a further form of holder.

Figure 13:
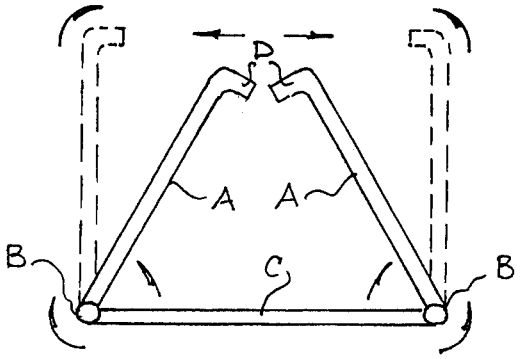

FIG. 13 schematically illustrates a still further form of holder.

The method will be described first with reference to FIGS. 1 to 8 and using a bag. The expandable holder may have many forms and these are dealt with later.

Figure 1:
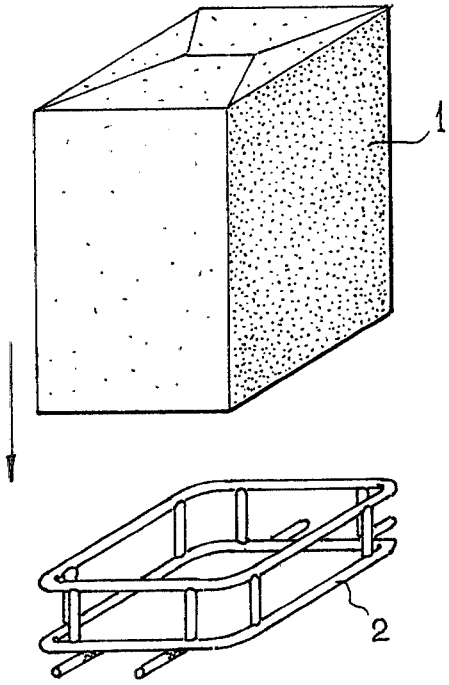

FIG. 1 illustrates a bag 1 having a basic substantially square cross-section and as would be used to wrap object(s) on a 46"×46" pallet. The basic size of the bag side could be in the order of 40" and thus the bag is initially 40"×40". The finished size will be in the order of 46"×46" embracing objects stacked to the perimeter of the pallet loading area. The holder 2 would have a minimum contracted side size of say 38" expandable to say 48".

Figure 2:
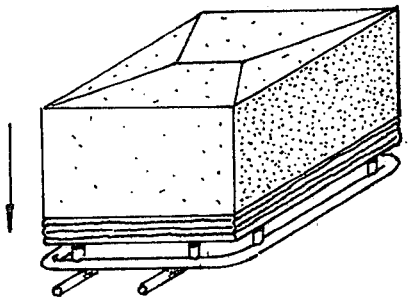

FIG. 2 shows the bag in the process being mounted on the expandable holder.

Figure 3:
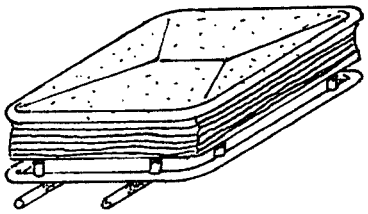

FIG. 3 shows the bag fully mounted on the holder.

Figure 4:
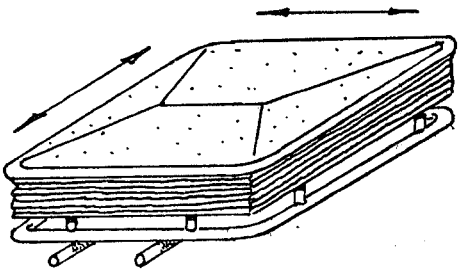

FIG. 4 shows the bag being expanded, say to 48"×48".

Figure 5:
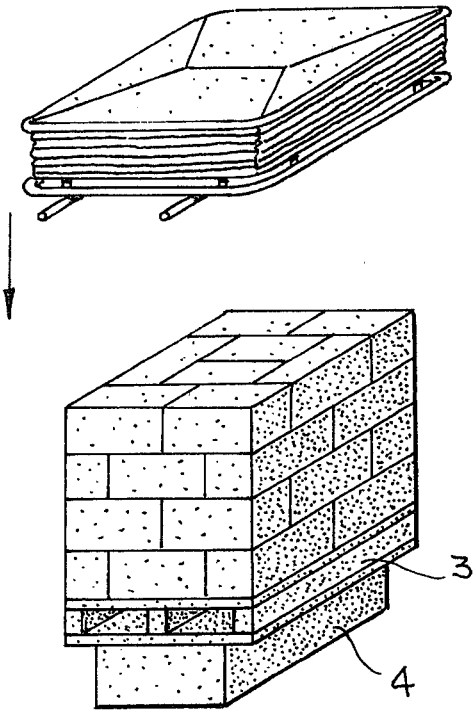

FIG. 5 shows the expanded bag-holder combination about to be lowered over a plurality of cartons stacked to the perimeter of a 46"×46" pallet 3 mounted on a stand 4.

Figure 6:
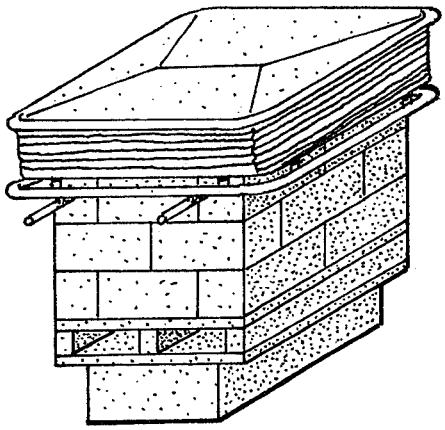

FIG. 6 shows the bag in the process of being stripped from the holder as it is lowered the stripping being due to the engagement of the bag end on the upper cartons.

Figure 7:
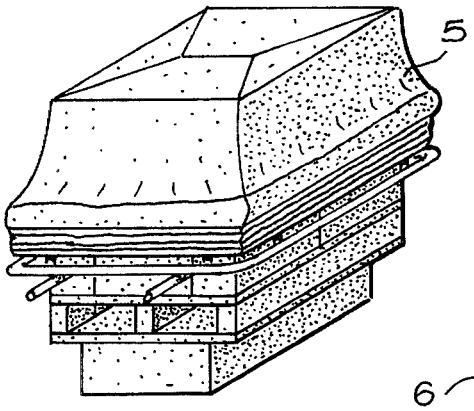

FIG. 7 shows the bag stripping further advanced and 5 indicates the contraction of the bag from the size on the holder to the size of the objects which is greater than the basic internal cross-section of the bag.

Figure 8:
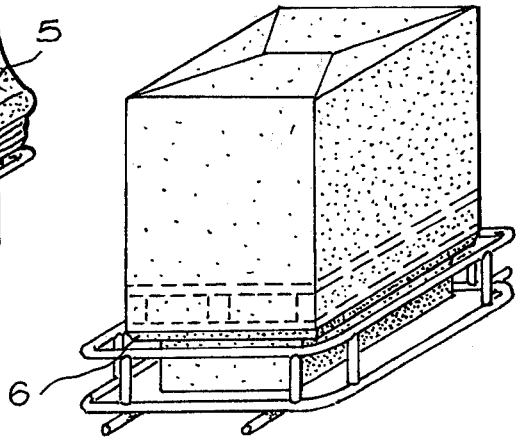

FIG. 8 shows the bag fully elastically embracing the load and the pallet and the open end 6 of the bag contracted and curled under the pallet to lock the bag at its lower end. The holder 2 at this stage is around the stand 4 and in its expanded form can be readily removed by moving it straight upwardly over the wrapped load.

The bag is preferably of flexible elastically stretchable plastic film.

The bag may be replaced by a tube without ends. The procedure would be as above except that portion of the bag adjacent the upper end would not be expanded and only a major part of the tube length would be on the holder and expanded. The non expanded upper end of the tube would act like the bag end to assist in stripping the tube from the holder. If desired, for example on high loads, a short bag could be placed on the load and a sleeve would be used to complete the wrapping. In this case the whole of the tube would be on the holder and expanded. The tube could be placed on the load either before or after the bag.

Turning now to the holder, many types are possible.

Figure 9:
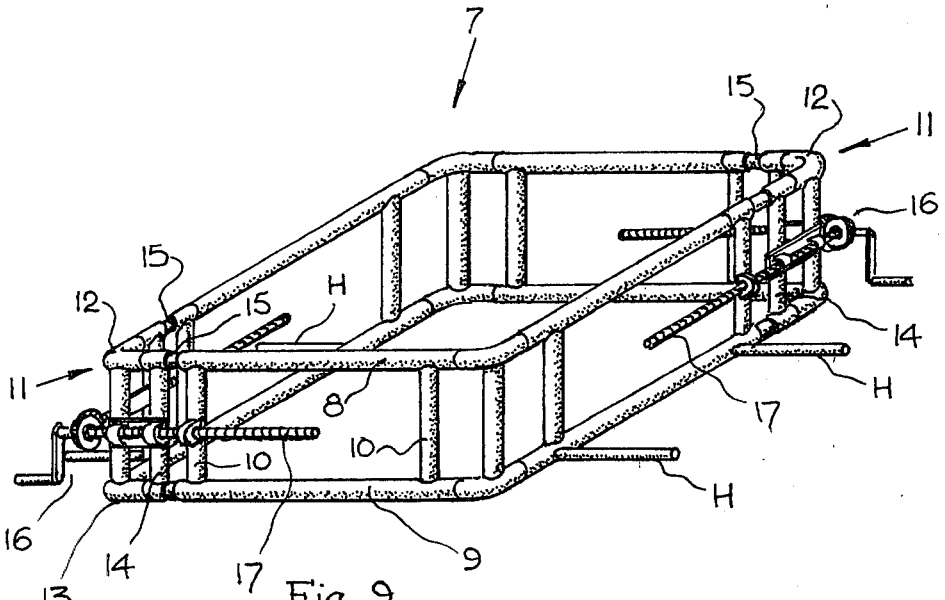
FIG. 9 illustrates one form of expandable holder.

FIG. 9 shows an expandible support frame 7 of two similar right angle parts. Each part has an upper rail 8 and a lower rail 9 separated by vertical bars 10. There are two similar corner assemblies 11 each comprising an upper bend 12 and a lower bend 13 separated by vertical bars 14. The bends 12–13 are telescopically coupled to the rails 8–9 at 15. Bevel gear assemblies 16 with threaded jack screws 17 are mounted on each corner assembly and the screws 17 engage nuts on the rails 9. By means of handles the gear 16 and screws 17 are rotated and the telescopic joints 15 provided a four way expansion of the support. The bag or tube is supported on the bars 10–14. This form of support is preferred for use with bags i.e. tubes with ends.

Figure 10:
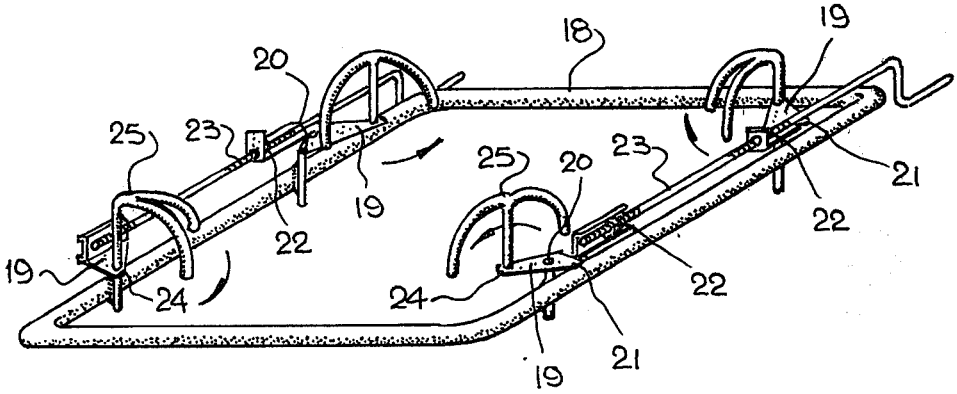
FIG. 10 illustrates a second form of expandable holder.

FIG. 10 is another form of support having a large fixed frame 18 with first order lever arms 19 pivotally connected thereto as at 20. First (outer) ends 21 of the arms 19 incorporate nuts 22. A jacking screw 23 with handle interconnects the nuts 22 of a pair of arms 19. At the second (inner) ends 24 of the arms 9 there are upstanding posts with pivoted right angle corner members 25. The arrangement is such that a bag (tube) supported on the corner members 25 is caused to expand in four directions as the jack screws 23 are operated to move the arm ends 21 of each pair of arms together and the arm ends 24 apart. The corner members 25 pivot during expansion to equalise the stretch of the bag (tube). The nuts 22 are right and left handed threaded as required as is the jack screw 23 so as to obtain the operation described above. FIG. 11 shows schematically the paths of travel of the corner supports 25 to increase the cross sectional dimension of the tube.

It will be understood that for manual operation handles indicated H in FIG. 9 would be used as required.

It is also within the scope of the invention to substitute mechanical devices such as piston and cylinder combinations for the jacking screw arrangements described above.

In the holders shown in FIGS. 12 and 13 the holder is for use with tube. The tube of plastic film is loaded over part of the rectangular frame of FIG. 12 and suitable means are used to jack the frame members apart to give the expanded form of the tube. In FIG. 13 only three arms are used. The two arms A are pivoted at B to the arm C and suitable means is used to jack the arms A apart. Such means could be incorporated adjacent each pivot B between arm A and C or jacking means could be used between the ends D of the arms A. The arrows show the direction of movement of the plastic of the tube as it is expanded.

I claim:

1. Stretch wrapping apparatus for stretch wrapping an object or an assembly of objects with a length of flexible elastically stretchable plastic film tube, said apparatus comprising a generally rectangular frame, said frame including two similar right-angled sub-frames oppositely disposed and two corner assemblies between adjacent ends of said sub-frames, said frame having a portion to hold said film tube so that said tube encircles said frame and extensible means coupling the corner assemblies to the sub-frames to move the sub-frames towards or away from the corner assemblies to contract or expand the frame and enlarge the cross-sectional dimension of the tube thereon so that when said frame 13 placed on said object, the enlarged tube encloses said object.

2. Apparatus according to claim 1 including, telescopic interconnections between each sub-frame and its associated corner assemblies.

3. Apparatus according to claim 1 wherein, said means to move the sub-frames towards or away from the corner assemblies comprises rotatable screws mounted on the corner assemblies and engaged in nuts on the sub-frames, gear means interconnecting the screws on each corner assembly thereby enabling the screws on each corner assembly to be rotated in unison.

* * * * *